United States Patent [19]

Durgin et al.

[11] 4,297,077

[45] Oct. 27, 1981

[54] COOLED TURBINE VANE

[75] Inventors: George A. Durgin, Schenectady; Daniel E. Demers, Melrose, both of Mass.

[73] Assignee: Westinghouse Electric Corp., Pittsburgh, Pa.

[21] Appl. No.: 55,833

[22] Filed: Jul. 9, 1979

[51] Int. Cl.[3] ..... F01D 5/08

[52] U.S. Cl. ..... 416/97 R; 415/115

[58] Field of Search ..... 416/96 R, 96 A, 97 R, 416/97 A; 415/115

[56] References Cited

U.S. PATENT DOCUMENTS

| | | | |
|---|---|---|---|
| 3,628,885 | 12/1971 | Sidenstick et al. | 416/97 |
| 3,767,322 | 10/1973 | Durgin et al. | 415/115 X |
| 3,844,678 | 10/1974 | Sterman et al. | 416/97 |
| 3,846,041 | 11/1974 | Albani | 416/96 A X |
| 4,056,332 | 11/1977 | Meloni | 416/96 A X |

*Primary Examiner*—Leonard E. Smith

*Attorney, Agent, or Firm*—E. F. Possessky

[57] ABSTRACT

A hollow gas turbine vane is shown enclosing, in spaced relation, a vane insert for receiving cooling air. The insert has a plurality of apertures for selectively directing jets of the cooling air against the internal walls of the vane. A portion of the air is discharged from within the vane chamber through a slit in the trailing edge which contains cooling pins extending transversely thereacross to maintain the slit dimensionally stable and also induce turbulence in the exhausting cooling air to improve its cooling effectiveness. Certain apertures in the insert adjacent the trailing edge are selectively directed to cause jets of the cooling air to impinge at the base of certain of the pins in the inlet area of the slit to promote turbulence in the air entering the slit and adjacent the internal face, thereby maximizing heat transfer from the slit walls to the air.

8 Claims, 4 Drawing Figures

COOLED TURBINE VANE

BACKGROUND OF THE INVENTION

1. Field of the Invention

This invention relates to cooled gas turbine vanes and more particularly to hollow vanes housing an insert having apertures directing jets of cooling air against the internal walls of the vane.

2. Description of the Prior Art

Hollow, air-cooled gas turbine vanes containing an insert for directing the cooling air to impinge against the internal walls of the vane are known in the art as exemplified by U.S. Pat. Nos. 4,056,332 and 3,767,322, with the latter patent and the present invention having a common assignee. The cooling air, after impinging on the inner walls of the vane is normally exhausted into the gas turbine motive gas flow path. A portion of the air may be exhausted through side openings in the vane walls to provide a protective layer of air adjacent the exterior surface of the vane for film cooling and another portion may be exhausted through a trailing edge outlet in the form of a radially extending narrow passage or slit from the internal chamber which also cools the area of the vane adjacent the trailing edge.

It has been suggested in the prior art air cooled vanes to employ pin-like members extending transversely within the trailing edge outlet to generate turbulence in the flowing air to improve the convective heat transfer between the air and the adjacent vane wall of the slit. The pins also serve as mechanical support to maintain the exhaust passage or slit dimensionally stable and minimize thermal distortion that could cause unpredictable air flow therethrough.

It was found that the pin height has no appreciable effect upon the heat transferred to the air flowing thereacross, and the greatest cooling effect was provided by turbulent air flow adjacent the internal wall surfaces of the slit. However, because of the generally broad entrance or throat leading to the downstream narrowed exhaust slit, the cooling air velocity, at its entrance, was generally insufficient to generate turbulence therein as it flowed around the initial pins in this entrance area. Thus, to maximize the heat transfer to the cooling air in the vicinity of the entrance area it was necessary to increase the air velocity across the initial pins sufficiently to cause turbulence in the air flow adjacent the slit wall surfaces. (The air velocity to the downstream narrowed passage of the slit was sufficient to cause turbulence in this downstream area providing adequate heat transfer to the air flowing therethrough.)

Two obvious alternatives for increasing the entrance velocity of the cooling air are (1) increase the volume of air flowing therethrough or (2) decrease the entrance throat area to the slit. However, because the efficiency of the turbine is reduced with each incremental increase in cooling air flow, it is preferable to maintain the volumetric flow rate of such cooling air to the vanes at a minimum. Further, because of the variations in heat absorption rates and resulting rates and amount of thermal expansion induced thereby along the vane walls and the attendant stresses associated therewith, it is preferable not to decrease the throat or entrance area to the slit by any sudden or abrupt increase in the wall thickness of the vane.

SUMMARY OF THE INVENTION

This invention provides a hollow air-cooled vane having an insert with specific openings for directing jets of air against the internal wall of the vane and with at least certain of the openings providing jets directed at the base of the cooling pins in those rows of pins extending across the relatively broad entrance to the exhaust slit to provide high velocity air flowing around these pins immediately adjacent the inner surface of the slit and thereby inducing turbulent flow in this air for enhanced cooling effectiveness immediately upon entering the exhaust slit. As the air moves on downstream and into the narrowed exhaust slit, the volume of air flowing therethrough maintains sufficient velocity to continue the turbulent flow as induced by the further downstream pins.

DESCRIPTION OF THE PREFERRED EMBODIMENT

Figure 1:
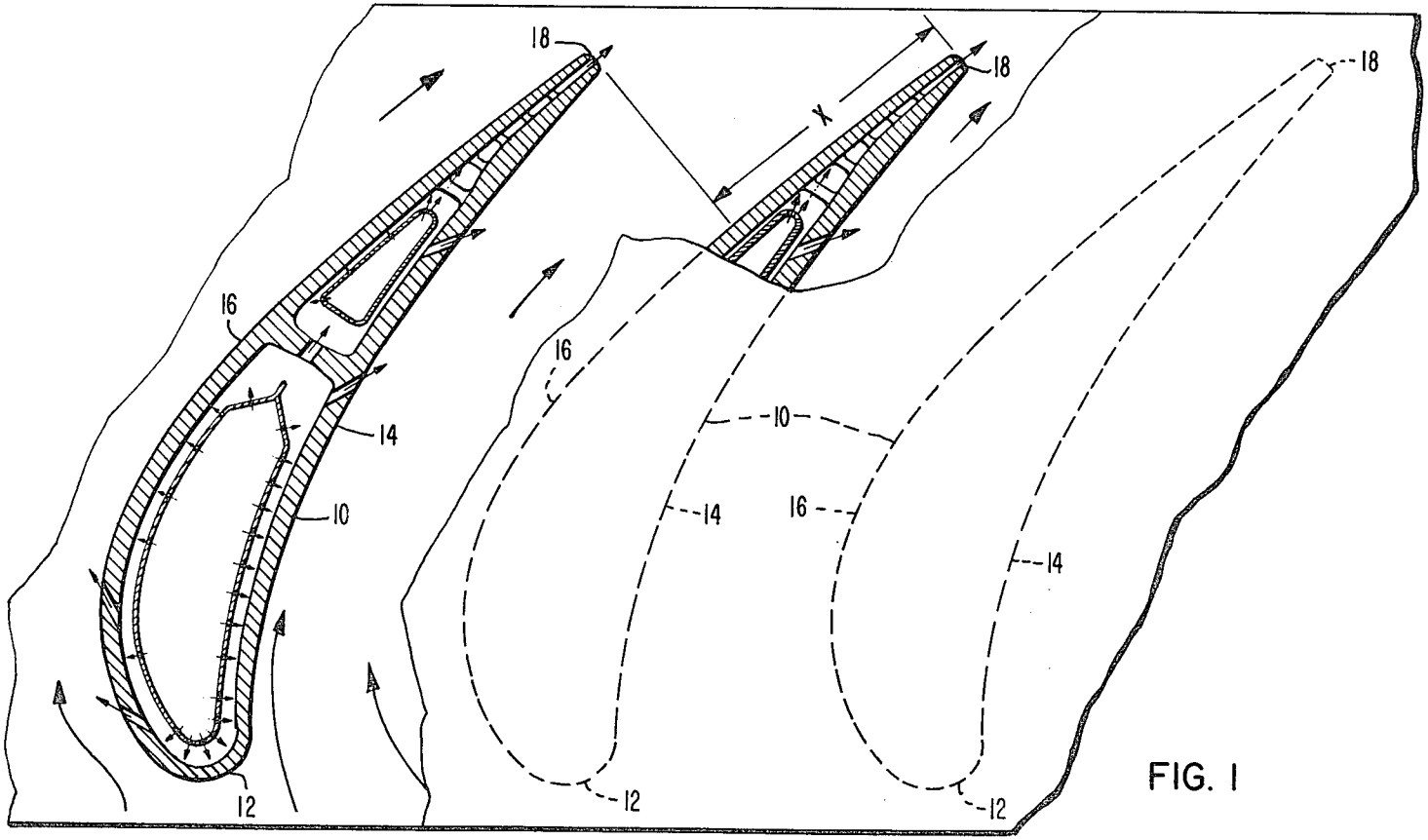
FIG. 1 is a top cross-sectional view of an array of hollow gas turbine vanes.
Figure 2:
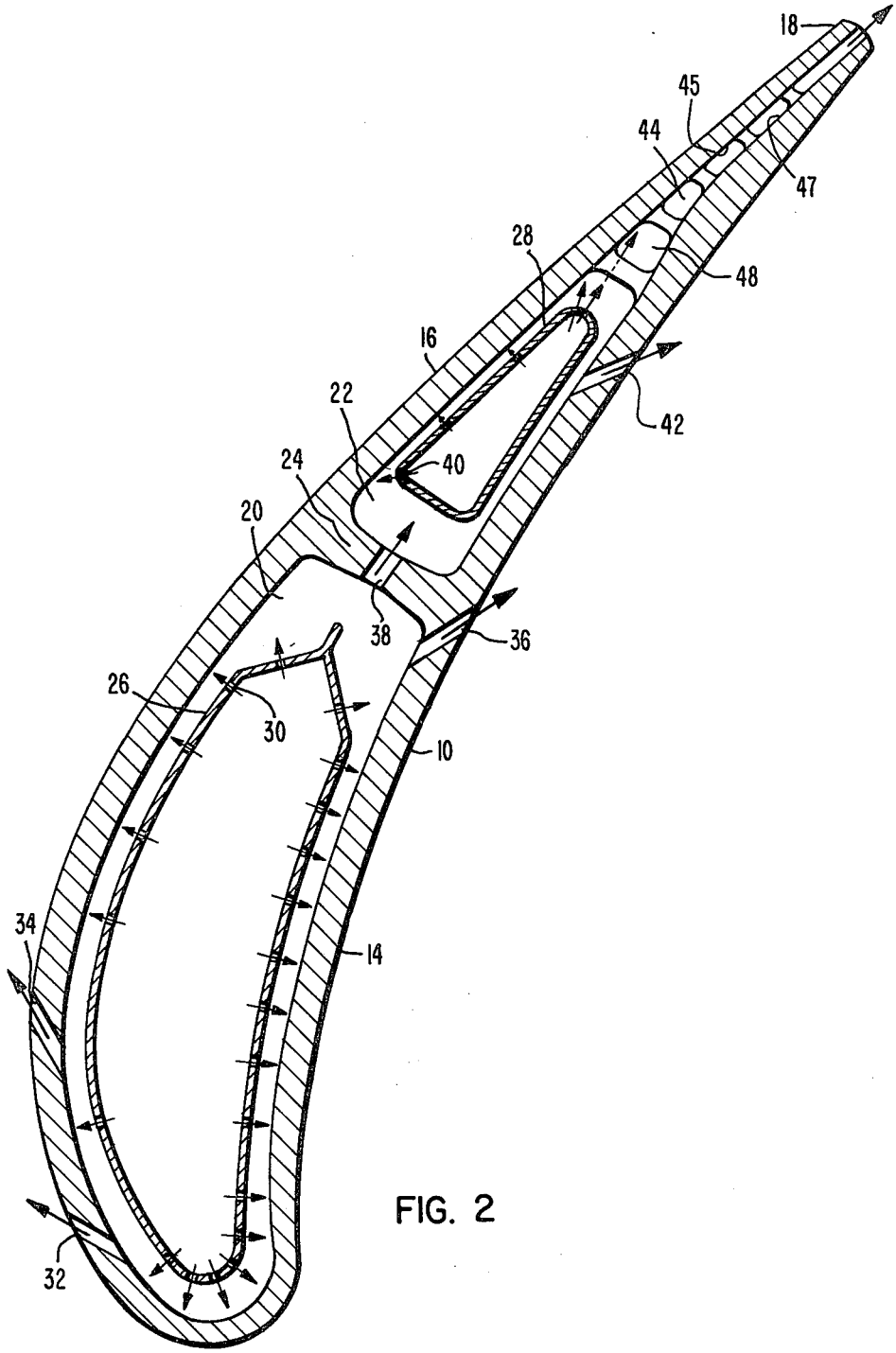
FIG. 2 is an enlarged cross-sectional view of a single vane of FIG. 1.

Referring to FIG. 1, a plurality of hollow gas turbine vanes are shown in generally assembled relationship to illustrate the orientation in the hot motive gas flow path through the engine, which is shown to be generally in the direction of the arrows. Thus, as seen, each vane 10 comprises an air-foil shaped configuration having a noise or leading edge 12, a pressure side or surface 14, a suction side 16 and a trailing edge 18. Each vane, as more clearly seen in FIG. 2, is generally hollow and, in the preferred embodiment shown, is divided into two internal chambers 20, 22 by an intermediate partition 24. Each chamber 20, 22 encloses a hollow insert 26, 28 having a configuration generally conforming to the internal contour of the respective chamber but in spaced relation thereto. The inserts 26, 28 contain apertures 30 in preselected locations. High pressure cooling air from the turbine compressor is directed into the inserts in a well known manner, and is exhausted through such apertures to form jets of air striking the inner walls of the chambers 20, 22 for impingement cooling (as shown by the arrows). More particularly, the apertures 30 of insert 26 in the nose chamber 20 are located to primarily impinge on the chamber wall opposite the leading edge 12 and also opposite the pressure side of the vane, as the corresponding external surfaces of the vane are more directly contacted by the hot motive fluid and thus require the greatest cooling.

The cooling air forced into the nose chamber 20 from the insert 26 is exhausted through a pair of rows of apertures 32, 34 from the chamber on the suction side adjacent the leading edge 12 and another row of apertures 36 from the nose chamber 20 on the pressure side generally adjacent the mid section thereof just upstream of the internal web or partition 24. This exhausted cooling air provides a layer of boundary air adjacent the exterior surfaces of the vane to limit direct contact of the hot motive fluid on such surfaces to inhibit heat transfer to the vane from the motive fluid. Still referring to FIG. 2, it is seen that the partition 24 contains a row of apertures 38 for exhausting the remainder of the cooling air from the nose chamber 20 into the downstream chamber 22. Again, as explained above, the insert 28 therein contains a plurality of apertures 40 in preselected positions for jetting a stream of cooling air, also delivered to insert 28, against selected areas on the internal walls of the downstream chamber 22. In this instance, the cooling air is primarily directed to the wall corresponding to the suction side of the vane.

The cooling air within the downstream chamber 22 is exhausted therefrom either through a row of apertures 42 in the downstream portion of the pressure side of the vane, again providing a layer of boundary air adjacent this downstream face, or through a slit 44 extending from the downstream chamber 22 to the trailing edge 18 of the vane.

Figure 3:
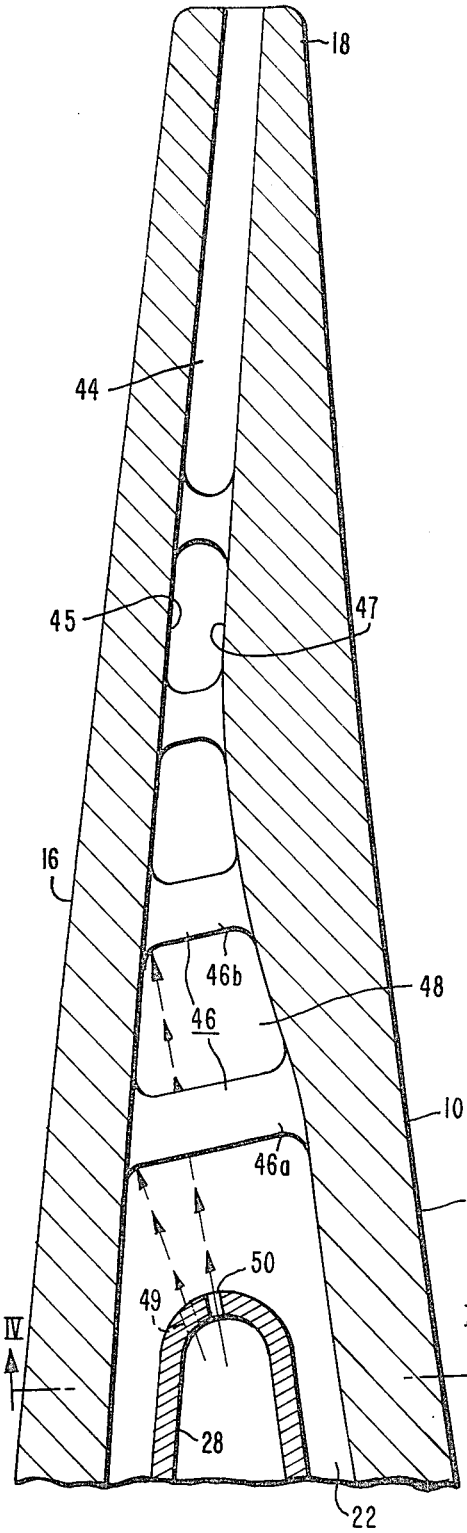
FIG. 3 is an enlarged cross-sectional view of the trailing edge portion of the vane of FIG. 2.
Figure 4:
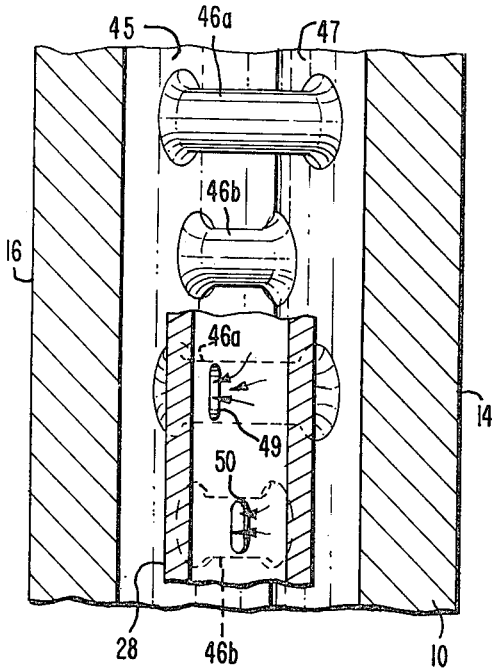
FIG. 4 is a view along line IV—IV of FIG. 3.

Referring now to FIGS. 3 and 4, it is therein seen that a plurality of rows of generally cylindrical cooling pins 46 extend across the slit 18 and are integral with the opposing walls defining the slit 44. It should be explained that the pins 46 of each row are offset radially from the pins of adjacent rows to intercept different layers of the cooling air flowing therethrough.

The pins 46, as previously explained, provide mechanical stability to the slit 44 to maintain its dimensions relatively constant regardless of expansion rate of the opposite sides of the vane. However, the main function of the pins is to induce turbulent flow in air flowing through the slit adjacent the internal walls to maximize the cooling effectiveness of this air. It will be noted that the transition zone 48 from the trailing chamber 22 to the slit 44 tapers from a broad inlet to an area downstream within the slit, from where the slit width remains relatively constant and, that at least two rows of pins 46*a* and 46*b* extend across this broad inlet and transition area.

The cooling air flowing over the mid portion of the transversely extending pins does not remove an appreciable amount of heat therefrom and therefore it is beneficial to have the greatest amount of cooling air flow closely adjacent internal vane walls defining the slit 44 and at a velocity such that the pins cause the flow to be turbulent. This provides the greatest cooling effect resulting from convectively cooling the inner surface of the slit walls which in turn is effective to cool the downstream portion of the vane generally adjacent the trailing edge 18.

To provide a high velocity air stream in the generally broad throat area which is sufficient to induce turbulence in the air stream as it flows around the pins, a pair of rows of apertures 49, 50 are disposed in the downstream wall of the insert 28. These apertures 49, 50 direct a jet of cooling air therethrough, and are selectively disposed in a staggered relationship such that one row 49 directs a jet of cooling air at the base of each pin in one row 46(*a*) of pins in the throat area 48 of the slit 44 thereby providing a high velocity airstream flowing over each pin of this row adjacent the wall and creating turbulence downstrream of this row of pins. The other row of apertures 50 directs a jet of cooling air at the base of the pins of the next downstream row 46(*b*) and the slit wall to again induce turbulence in the air flow immediately downstream of these pins and increase the cooling effectiveness of this air. The continued narrowing of the slit width subsequent to this row 46(*b*) of pins maintains a downstream air velocity sufficient to cause the downstream rows of pins to create turbulence in the air flow adjacent to said walls to maintain the cooling effectiveness throughout the remaining portion of the trailing portion of the blade.

It will be noted that in the preferred embodiment shown, the cooling air is directed to the base of the pins on only one wall of the slit, namely the suction side of the vane. This is because the film of boundary air provided through exhaust aperture rows 36, 42 on the pressure side of the vane is sufficiently effective so that additional cooling of the trailing or downstream portion 18 on the pressure side of the vane is not required. However, on the suction side, and especially that portion thereof which extends beyond the facing pressure side of the adjacent vane (see FIG. 1 where this portion of the vane is identified generally by the dimension X), the path for the hot motive gas does not have the confinement and assumes a rather random, turbulent motion that generally prevents a continuous layer of boundary air being maintained adjacent the suction surface of the vane. Thus, as this portion of the vane surface is exposed to the heating effects of the hot motive gas, it must receive the primary cooling for the trailing portion of the vane (this also explains why the cooling air apertures from the downstream insert 28 impinge upon the chamber wall on the suction side). However, it is evident that should it be determined that the pressure side of the vane requires additional cooling on the downstream portion, selectively aimed apertures could be provided directing cooling air at the base of the cooling pins on that side of the vane also. The objective is to require a minimum volumetric air flow and yet maintain an air velocity across the pins sufficient to induce turbulence in the air flow adjacent the slit walls to increase its cooling effectiveness for the vane wall. Thus, by virtue of aiming the high velocity air exiting the insert 28, at least in that portion 48 of the slit where the air velocity would otherwise by insufficient to produce turbulence at the juncture of the wall and pins, the volume of air can be minimized and the cooling effectiveness thereof maximized.

We claim:

1. A turbine vane having an airfoil portion providing a leading edge, a suction side, a pressure side and a trailing edge, and wherein said airfoil portion is generally hollow to define an internal chamber to receive cooling air, a slit from said internal chamber through said trailing edge generally throughout the radial extent of said airfoil portions, and wherein the opposed internal walls defining said slit converge from generally a broad inlet area adjacent said chamber to a relatively narrow passage downstream thereof, a plurality of radial rows of pin-like members extending transversely across said slit and integral with the opposed walls defining said slit, and wherein the members of each row are radially offset with respect to the members of any adjacent row to intercept the cooling air flowing through said slit at different levels, a hollow insert disposed within said chamber for initially receiving at least a portion of the cooling air entering said chamber, said insert having a wall member generally adjacent said slit inlet area and apertures in said insert wall for directing cooling air exiting therethrough primarily in a direction to impinge on a selected plurality of junctures of said members and at least one wall of said slit to provide sufficient velocity in said cooling air to cause said juncture to induce turbulence in said cooling air as it flows adjacent said wall and downstream of said juncture to effectively cool said vane.

2. Turbine vane structure according to claim 1 wherein said inlet area includes at least a first and second row of members extending transversely thereacross, and wherein said apertures in said insert are aimed to direct relatively high velocity cooling air at the juncture of said members in said first and second row adjacent one wall of said slit.

3. Turbine vane structure according to claim 2 having a row of apertures from said chamber through said pressure side of said airfoil generally upstream from said trailing edge to deliver a film of cooling air to the downstream surface of said vane and wherein said insert apertures are aimed at the juncture of said members and sais slit wall corresponding to the suction side of said airfoil.

4. Turbine vane structure according to claim 2 wherein said slit walls converge downstream of said second row of members to a narrow width wherein the velocity of air passing therethrough is thereafter sufficient for said downstream members to induce turbulent flow adjacent said slit walls.

5. A generally hollow turbine vane defining a chamber in the airfoil portion thereof for receiving pressurized cooling air, said airfoil portion defining a leading edge and a downstream trailing portion terminating in a trailing edge, a coolling air outlet slit from said chamber through said trailing edge, with said slit defined by opposed internal walls converging from a relatively broad inlet area to a relatively narrow air passage at a downstream intermediate point, a plurality of rows of radially staggered projections integral with said opposed internal walls extending across said slit, with at least one row in said inlet area, and a generally hollow insert in said chamber for receiving at least a portion of the pressurized air, said insert having a wall member generally adjacent said one row of projections and cooling fluid passages in said wall for directing discrete air flow in a direction to impinge on the juncture of said one row and the slit wall whereby said juncture induces turbulence in said cooling air as it flows downstream thereof to cooling the trailing portion of said vane.

6. Structure according to claim 5 including a plurality of radial rows of projections in said inlet area and said insert includes cooling fluid passages for directing cooling air flow to the juncture of said projections in said plurality of rows with at last one wall of said slit.

7. Structure according to claim 6 wherein said internal wall of said slit receiving said discrete cooling fluid paths as directed by said insert is the internal wall of the suction side of said vane.

8. Structure according to claim 7 wherein said slit walls converge downstream of a second radial row of said projections to a narrow width wherein the velocity of cooling air flowing over the further downstream rows of projection is sufficient for said projections to cause turbulence in said air adjacent said slit walls to cool the trailing portion of said vane.

* * * * *